US009832820B2

(12) United States Patent
Darney

(10) Patent No.: US 9,832,820 B2
(45) Date of Patent: Nov. 28, 2017

(54) DOMESTIC APPLIANCE WITH CONTROLLED DOOR OPENING

(75) Inventor: Ian Darney, Cardiff (GB)

(73) Assignee: PANASONIC MANUFACTURING U.K. LTD., Cardiff (GB)

( * ) Notice: Subject to any disclaimer, the term of this patent is extended or adjusted under 35 U.S.C. 154(b) by 812 days.

(21) Appl. No.: 12/305,967

(22) PCT Filed: Jun. 22, 2007

(86) PCT No.: PCT/EP2007/005545
§ 371 (c)(1),
(2), (4) Date: Dec. 20, 2008

(87) PCT Pub. No.: WO2007/147628
PCT Pub. Date: Dec. 27, 2007

(65) Prior Publication Data

US 2011/0139772 A1 Jun. 16, 2011

(30) Foreign Application Priority Data

Jun. 22, 2006 (GB) ..... 0612374.9

(51) Int. Cl.
*H05B 6/66* (2006.01)
*A47B 96/00* (2006.01)
(Continued)

(52) U.S. Cl.
CPC ..... *H05B 6/6417* (2013.01); *E05B 47/0002* (2013.01); *E05B 47/026* (2013.01);
(Continued)

(58) Field of Classification Search
CPC .. E05B 47/0002; E05B 47/026; E05B 43/005; E05B 47/0004; E05B 63/248;
(Continued)

(56) References Cited

U.S. PATENT DOCUMENTS 3,823,294 A * 7/1974 Takayama et al. ..... 219/724
4,360,723 A * 11/1982 Fukuda et al. ..... 219/711
(Continued)

FOREIGN PATENT DOCUMENTS

DE 4040424 A1 6/1992
DE 4229731 A1 4/1993
(Continued)

OTHER PUBLICATIONS

International Search Report issued in the parallel GB case (GB0612374.9) dated Sep. 26, 2006.
(Continued)

*Primary Examiner* — Eric Stapleton
(74) *Attorney, Agent, or Firm* — Myers Bigel, P.A.

(57) ABSTRACT

A domestic appliance (for example, a microwave oven), comprising: a housing; a front door; a retention mechanism (for example including a latch), located within the housing and engageable with the door; wherein the retention mechanism is movable between a first configuration, in which the door is retained in a closed position, and a second configuration, in which the door is non-engaged; an electromechanical actuator (for example a relay), adapted to move the retention mechanism out of said first configuration; and a controller (for example a microprocessor coupled to the relay, the microprocessor being operable in responsive to one or more signals to activate the relay, and thereby release the door from the closed position. Under spring bias, the door thus opens to about 30-45 degrees. The microprocessor-controlled door opening may be operable in three or more modes, including: actuation of a touch switch, remote control, or a microwave end of cooking.

18 Claims, 4 Drawing Sheets

(51) Int. Cl.

| | |
|---|---|
| ***E05C 3/12*** | (2006.01) |
| ***F27D 11/00*** | (2006.01) |
| ***H01H 9/20*** | (2006.01) |
| ***H05B 6/64*** | (2006.01) |
| ***E05B 47/00*** | (2006.01) |
| ***E05B 47/02*** | (2006.01) |
| ***F24C 15/02*** | (2006.01) |
| *E05B 43/00* | (2006.01) |
| *E05B 63/24* | (2006.01) |

(52) U.S. Cl.
CPC ..... *F24C 15/022* (2013.01); *H05B 6/6414* (2013.01); *E05B 43/005* (2013.01); *E05B 47/0004* (2013.01); *E05B 63/248* (2013.01); *Y10T 292/1082* (2015.04)

(58) Field of Classification Search
CPC ... F24C 15/022; H05B 6/6414; H05B 6/6417; Y10T 292/1082
USPC ..... 219/702, 412; 292/201; 312/326; 335/165; 398/106
See application file for complete search history.

(56) References Cited

U.S. PATENT DOCUMENTS

| | | | | |
|---|---|---|---|---|
| 4,374,320 | A * | 2/1983 | Barnett | 219/413 |
| 4,450,335 | A * | 5/1984 | Shimizu et al. | 219/723 |
| 4,825,027 | A | 4/1989 | Yoon | 219/10.55 C |
| 5,493,099 | A * | 2/1996 | McWilliams, III | 219/413 |
| 5,801,363 | A * | 9/1998 | Michaluk, III | 219/734 |
| 5,886,644 | A * | 3/1999 | Keskin et al. | 340/5.73 |
| 6,137,096 | A * | 10/2000 | Seo | 219/722 |
| 6,525,644 | B1 * | 2/2003 | Stillwagon | 340/5.61 |
| 2002/0014486 | A1 * | 2/2002 | Chun | 219/702 |
| 2004/0108106 | A1 * | 6/2004 | Clark et al. | 165/206 |
| 2004/0255929 | A1 * | 12/2004 | Miller et al. | 126/500 |
| 2005/0121919 | A1 * | 6/2005 | Smock et al. | 292/110 |

FOREIGN PATENT DOCUMENTS

| | | | | |
|---|---|---|---|---|
| EP | 031 142 | A1 | 7/1981 | |
| EP | 0342307 | A2 | 11/1989 | |
| EP | 0 917 404 | A1 | 5/1999 | |
| GB | 1457579 | A | 4/1973 | |
| WO | WO 2007/147628 | A1 | 12/2007 | A47J 37/07 |

OTHER PUBLICATIONS

International Search Report and Written Opinion dated Aug. 22, 2007, for International Application No. PCT/EP2007/005545, dated Sep. 14, 2007, 8 pp.

International Preliminary Report on Patentability dated Jul. 4, 2008, for International Application No. PCT/EP2007/005545, dated Oct. 15, 2008, 8 pp.

* cited by examiner

DOMESTIC APPLIANCE WITH CONTROLLED DOOR OPENING

BACKGROUND OF THE INVENTION

Field of the Invention

The present invention relates to domestic appliances, and more particularly to domestic appliances with special-purpose control of door opening.

Discussion of the Related Art

It is conventional for microwave ovens, and other electrical domestic appliances with doors, to employ a purely mechanical, e.g. latched, opening mechanism for the door. For example, published UK patent application GB2410059A discloses domestic electrical appliance such as a refrigerator or microwave oven, with a door that is laterally hinged between a lower supporting hinge and an upper hinge. The upper hinge comprises an angled bracket with a projecting portion and the upper edge of the door is provided with a ramp-shaped slide block that progressively interferes with the projecting portion when the door is opened to angles greater than a predetermined value, for example 130-140 degrees, exerting an increasing resistant torque as the angle of opening increases.

A problem with conventional appliances is that often considerable force must be applied by the user, to a lever, handle or button, to mechanically release the latch or door lock in order to open the door; thus, for example, this can be problematic or unsatisfactory for the disabled and frail to use. Further, for such users, as well as the able bodied, such prior art mechanisms require the user to be physically present at the device to apply the force to open the door.

A further problem, particularly in relation to microwave ovens, is that they do not support automatic (or remote-controlled) opening of the door immediately, or some relatively short time after, cooking is finished (i.e. application of microwave power ceases). For example, it may be undesirable for hot, often steaming, food to remain standing in the oven with the door closed, and there is often a direction associated with the food or meal for it to be left standing in the "open" for some moments, prior to serving.

SUMMARY OF THE INVENTION

The present invention provides a domestic appliance, comprising: a housing; a front door; a retention mechanism, located within the housing and engageable with the door; wherein the retention mechanism is movable between a first configuration, in which the door is retained in a closed position, and a second configuration, in which the door is non-engaged; an electromechanical actuator, adapted to move the retention mechanism out of said first configuration; and a controller, coupled to the actuator, the controller being operable in response to one or more signals to activate the actuator, and thereby release the door from the closed position.

Preferably, the retention mechanism includes a rotatable member rotated, in use, by the electromechanical actuator while the actuator is activated; and a spring biasing element; wherein, in use, during at least part of the movement of the retention mechanism between the first configuration and the second configuration, the spring biasing element acts on the door, such that the door rotates to a partially open position. Preferably, in use, the electromechanical actuator moves the rotatable member into a position such that the spring biasing element acts on the door such that the door rotates to the partially open position. Preferably, the rotatable member has a guide surface, the guide surface including a transition point and being disposed such that, in use, a key member attached to the door is capable of sliding contact with the rotatable member along the guide surface; wherein, after the key member has slid beyond the transition point 324, forces due to gravity and to the spring biasing element operate on the door such that the door rotates to the partially open position.

According to one embodiment: the controller is operable in a switch activated mode; the housing is provided thereon with an electrical switch, for example a touch switch, coupled to the controller and operable by a user; and the controller is operable, in use, to activate said actuator when the detected signal from said electrical switch is HIGH.

According to a further embodiment: the controller is alternatively or additionally operable in a remote activated mode; the housing is provided thereon with a wireless receiver unit, for example an infra-red (IR) receiver, coupled to the controller and operable by a user remote unit, for example an IR remote control; and the controller is operable, in use, to activate said actuator when the detected signal from said wireless receiver unit is HIGH.

According to a further embodiment: the appliance is capable of performing a temporary electrical operation, wherein: the controller is alternatively or additionally operable in an auto-open mode, the housing is provided thereon with a user selection interface, for example buttons and/or dials and a display, coupled to the controller and operable by a user, the user selection interface including an auto-open setting selectable, in use, by the user; the controller is coupled for receiving an input signal (HIGH, LOW), indicative of whether the electrical operation in the appliance is on or off, respectively; and the controller is operable, in use, to activate said actuator when the received signal is LOW.

According to a further embodiment: the appliance is capable of performing a temporary electrical operation, wherein: the controller is alternatively or additionally operable in an delayed auto-open mode; the controller is coupled to a memory device, for storing a time period; the controller is coupled for receiving an input signal (HIGH, LOW), indicative of whether the electrical operation in the appliance is on or off, respectively; and whereby the controller is operable, in use, to activate said actuator when the controller determines that (a) the received signal is LOW, and (b) said time period has elapsed. Preferably, the user selection interface includes an delayed auto-open setting selectable, in use, by the user; wherein the user selection interface is operable by the user for inputting said time period prior to storage in the memory device. For example, the time period may be approximately (a) 1-20 seconds, (b) up to 1 minute, or (c) 1-5 minutes. However, in practice the period may be any number of minutes up to an hour, or any number of hours (e.g. up to 24), or any enumerable amount of time.

In alternative embodiments, instead of being operable in response to a detected or received signal being HIGH, the controller is operable in response to (a) the detected or received signal being LOW, or (b) vice versa, or (c) the detected or received signal undergoing any predetermined detectable change in state or voltage level.

Suitably, the electromagnetic actuator comprises a solenoid, the armature of the solenoid cooperating, in use with the retention mechanism.

Suitably, the appliance is (a) an oven, and the temporary electrical operation is cooking by means of any combination of microwave, grill, convection or steaming, or (b) a bread-maker, yoghurt maker or the like, and the temporary electrical operation is electrical warming or heating.

Using techniques according to the invention, appliances such as microwave ovens can be opened with very little manual effort from the user, e.g. via touch switch or remote control, benefiting those of a frail disposition.

The invention enables the appliance to open automatically, such as the end of electrical (microwave, grill, convective) cooking. This can reduce the amount of moisture build-up on the interior of the oven due to steam.

BRIEF DESCRIPTION OF THE DRAWINGS

Embodiments of the invention will now be described in detail, by way of example, with reference to the accompanying drawings, in which.

In the description and drawings, like numerals are used to designate like elements.

DETAILED DESCRIPTION OF THE PREFERRED EMBODIMENTS

Figure 1A:
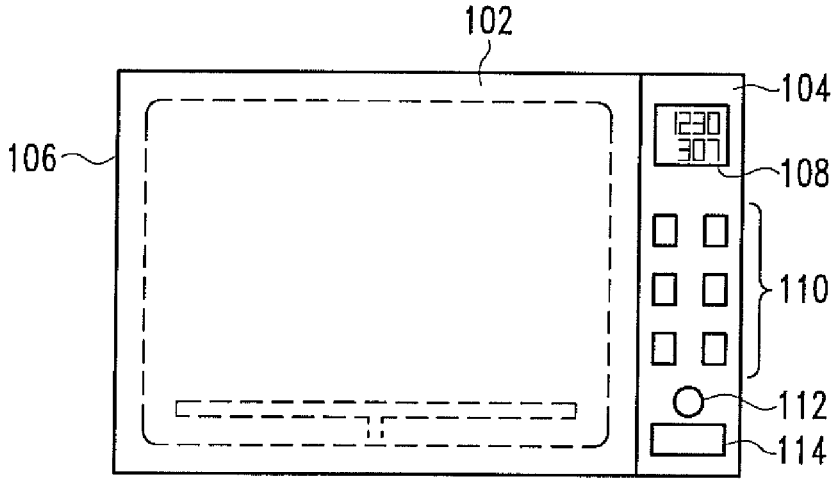
FIG. 1 shows a domestic appliance (microwave oven) in accordance with an embodiment of the present invention (a) in front view, and (b) in plan view following door opening.

This invention concerns domestic appliances having a hinged door, such as ovens, fridges, freezers and the like. The invention is, for example, particularly beneficial in relation to microwave ovens. However, the invention is applicable to electrical domestic whether freestanding or adapted for built-in installation, i.e. installed within a framework or outer housing, or are mounted with kitchen or other household furniture (sometimes known as "slot-in" or "built-in" appliances).).

The present invention provides a domestic appliance, comprising: a housing; a front door; a retention mechanism, located within the housing and engageable with the door; wherein the retention mechanism is movable between a first configuration, in which the door is retained in a closed position, and a second configuration, in which the door is non-engaged; an electromechanical actuator, adapted to move the retention mechanism out of said first configuration; and a controller, coupled to the actuator, the controller being operable in response to one or more signals to activate the actuator, and thereby release the door from the closed position.

Preferably, the retention mechanism includes a rotatable member rotated, in use, by the electromechanical actuator while the actuator is activated; and a spring biasing element; wherein, in use, during at least part of the movement of the retention mechanism between the first configuration and the second configuration, the spring biasing element acts on the door, such that the door rotates to a partially open position. Preferably, in use, the electromechanical actuator moves the rotatable member into a position such that the spring biasing element acts on the door such that the door rotates to the partially open position. Preferably, the rotatable member has a guide surface, the guide surface including a transition point and being disposed such that, in use, a key member attached to the door is capable of sliding contact with the rotatable member along the guide surface; wherein, after the key member has slid beyond the transition point 324, forces due to gravity and to the spring biasing element operate on the door such that the door rotates to the partially open position.

According to one embodiment: the controller is operable in a switch activated mode; the housing is provided thereon with an electrical switch, for example a touch switch, coupled to the controller and operable by a user; and the controller is operable, in use, to activate said actuator when the detected signal from said electrical switch is HIGH.

According to a further embodiment: the controller is alternatively or additionally operable in a remote activated mode; the housing is provided thereon with a wireless receiver unit, for example an infra-red (IR) receiver, coupled to the controller and operable by a user remote unit, for example an IR remote control; and the controller is operable, in use, to activate said actuator when the detected signal from said wireless receiver unit is HIGH.

According to a further embodiment: the appliance is capable of performing a temporary electrical operation, wherein: the controller is alternatively or additionally operable in an auto-open mode, the housing is provided thereon with a user selection interface, for example buttons and/or dials and a display, coupled to the controller and operable by a user, the user selection interface including an auto-open setting selectable, in use, by the user; the controller is coupled for receiving an input signal (HIGH, LOW), indicative of whether the electrical operation in the appliance is on or off, respectively; and the controller is operable, in use, to activate said actuator when the received signal is LOW.

According to a further embodiment: the appliance is capable of performing a temporary electrical operation, wherein: the controller is alternatively or additionally operable in an delayed auto-open mode; the controller is coupled to a memory device, for storing a time period; the controller is coupled for receiving an input signal (HIGH, LOW), indicative of whether the electrical operation in the appliance is on or off, respectively; and whereby the controller is operable, in use, to activate said actuator when the controller determines that (a) the received signal is LOW, and (b) said time period has elapsed. Preferably, the user selection interface includes an delayed auto-open setting selectable, in use, by the user; wherein the user selection interface is operable by the user for inputting said time period prior to storage in the memory device. For example, the time period may be approximately (a) 1-20 seconds, (b) up to 1 minute, or (c) 1-5 minutes. However, in practice the period may be any number of minutes up to an hour, or any number of hours (e.g. up to 24), or any enumerable amount of time.

In alternative embodiments, instead of being operable in response to a detected or received signal being HIGH, the controller is operable in response to (a) the detected or received signal being LOW, or (b) vice versa, or (c) the detected or received signal undergoing any predetermined detectable change in state or voltage level.

Suitably, the electromagnetic actuator comprises a solenoid, the armature of the solenoid cooperating, in use with the retention mechanism.

Suitably, the appliance is (a) an oven, and the temporary electrical operation is cooking by means of any combination of microwave, grill, convection or steaming, or (b) a breadmaker, yoghurt maker or the like, and the temporary electrical operation is electrical warming or heating.

Using techniques according to the invention, appliances such as microwave ovens can be opened with very little manual effort from the user, e.g. via touch switch or remote control, benefiting those of a frail disposition.

The invention enables the appliance to open automatically, such as the end of electrical (microwave, grill, convective) cooking. This can reduce the amount of moisture build-up on the interior of the oven due to steam.

Figure 1B:
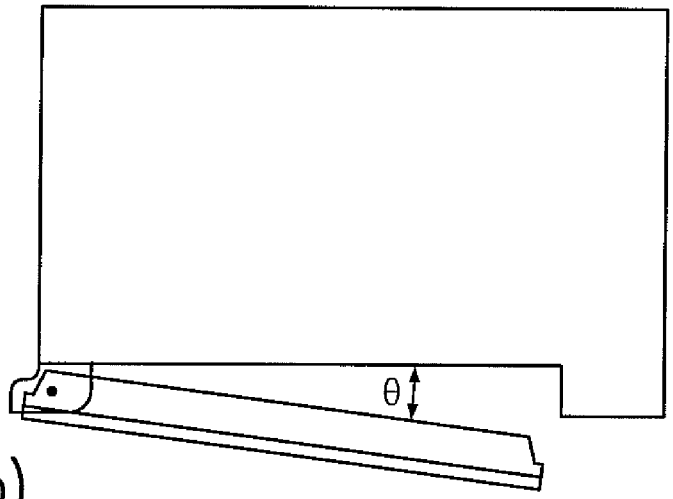

FIG. 1 shows a domestic appliance (microwave oven) in accordance with an embodiment of the present invention (a) in front view, and (b) in plan view following door opening. Referring to FIG. 1(*a*), this shows the door 102 of the oven and the right hand control panel 104. The door 102 is hinged at the left side 106, as is conventional.

In the control panel 104 is a display 108, typically a LED numeric display, for example displaying current time and remaining cooking time; however, it will be appreciated that many forms of display, e.g. LCD, may be used. Also provided are a number of control/selection buttons 110, a dial 112 and a door release switch 114. In accordance with this embodiment of the invention, the control/selection buttons 110 and the door release switch 114 are of the momentary switch type, or more preferably the touch switch type. Persons skilled in the art will appreciate that known membrane, tactile or touch switch components, or any other similar switch types, may be used.

Referring to FIG. 1(*b*), this shows the microwave oven in plan view following door opening, i.e. following user actuation of the door release switch 114, or though other initiation of the door opening mechanism, to be described hereinafter. As a result, the door has opened by an angle θ, which may be of the order 30-45 degrees, thus enabling the user to then fully open the door 102. Of course, the initial opening angle θ may be some finite angle less than 30 degrees, or may be greater than 45 degrees; it will be appreciated that the mechanism may open the door by anything up to about 90 degrees (e.g. for built-in appliances), and possibly more (e.g. anything up to about 180 degrees for free-standing units).

Figure 2:
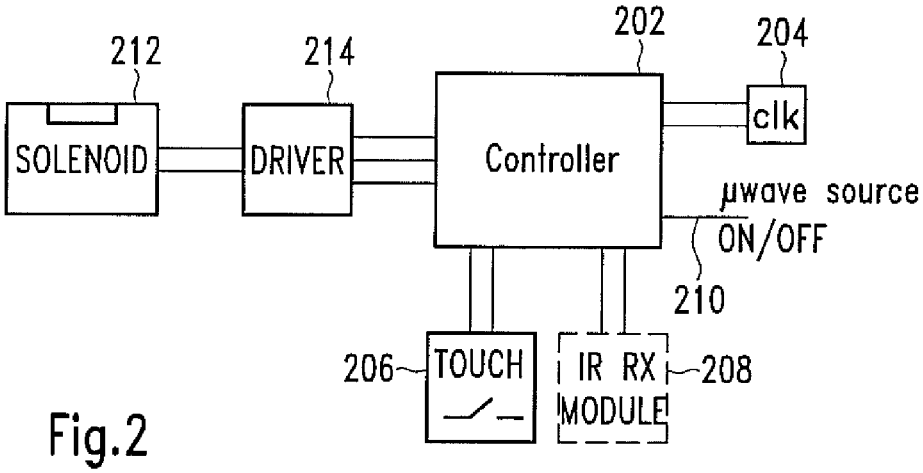
FIG. 2 illustrates part of the electrical system for the microwave oven of FIG. 1.

FIG. 2 illustrates part of the electrical system for the microwave oven of FIG. 1. As can be seen, the circuit includes a controller (e.g. microprocessor controller) 202. Coupled to the controller 202 are clock generator 204, touch switch 206 and IR receiver module 208. The controller 202 also receives at one of its inputs a signal via line 210 from the microwave power circuit, indicative of whether microwave power in the appliance is off or on. As is conventional, the controller may be coupled to RAM, ROM or other suitable memory devices (not shown), the latter storing, among other things, system setting, and settings (e.g. auto-open, time-delayed auto-open) that may have been input by the user via control panel 104 (FIG. 1).

Based on the status of the inputs from the touch switch 206, the IR receiver module 208, the controller 202 controls the actuation of the solenoid 212 via driver circuit 214. Thus, the controller 202 is able to implement several modes of door opening—

(i) following user actuation of touch switch, (ii) automatically after microwave power goes off, (ii) automatically a certain time after microwave power going off, and (iv) following receipt of command via IR remote control. Alternatively, the door may be opened as a result of some other predefined sequence, such as prompting the user to stir or turn over food currently being cooked.

There is described below in pseudocode just one example of a procedure for use by the controller 202 for controlling the actuation of the solenoid 212. However, it will be appreciated by persons skilled in the art that other suitable procedure may be used to implement some or all of the techniques according to embodiments of the invention.

```
While system is on do
  Sense cooking power status
  Sense touch switch status
  Sense IR receiver status
  Sense auto-open setting
  Sense door open status
  If door is open then don't set actuator control signal HIGH
  If (touch switch is HIGH or IR receiver is HIGH) and
    cooking power is on then display error message (if any)
    else set actuator control signal HIGH
  If auto-open setting is on
    fetch time auto-open time period
    if auto-open time period is zero and actuator control
      signal is LOW then set actuator control signal HIGH
    else do
      count down auto-open time period
      while auto-open time period not expired
      if actuator control signal is LOW then set actuator
        control signal HIGH
```

Figure 3A:
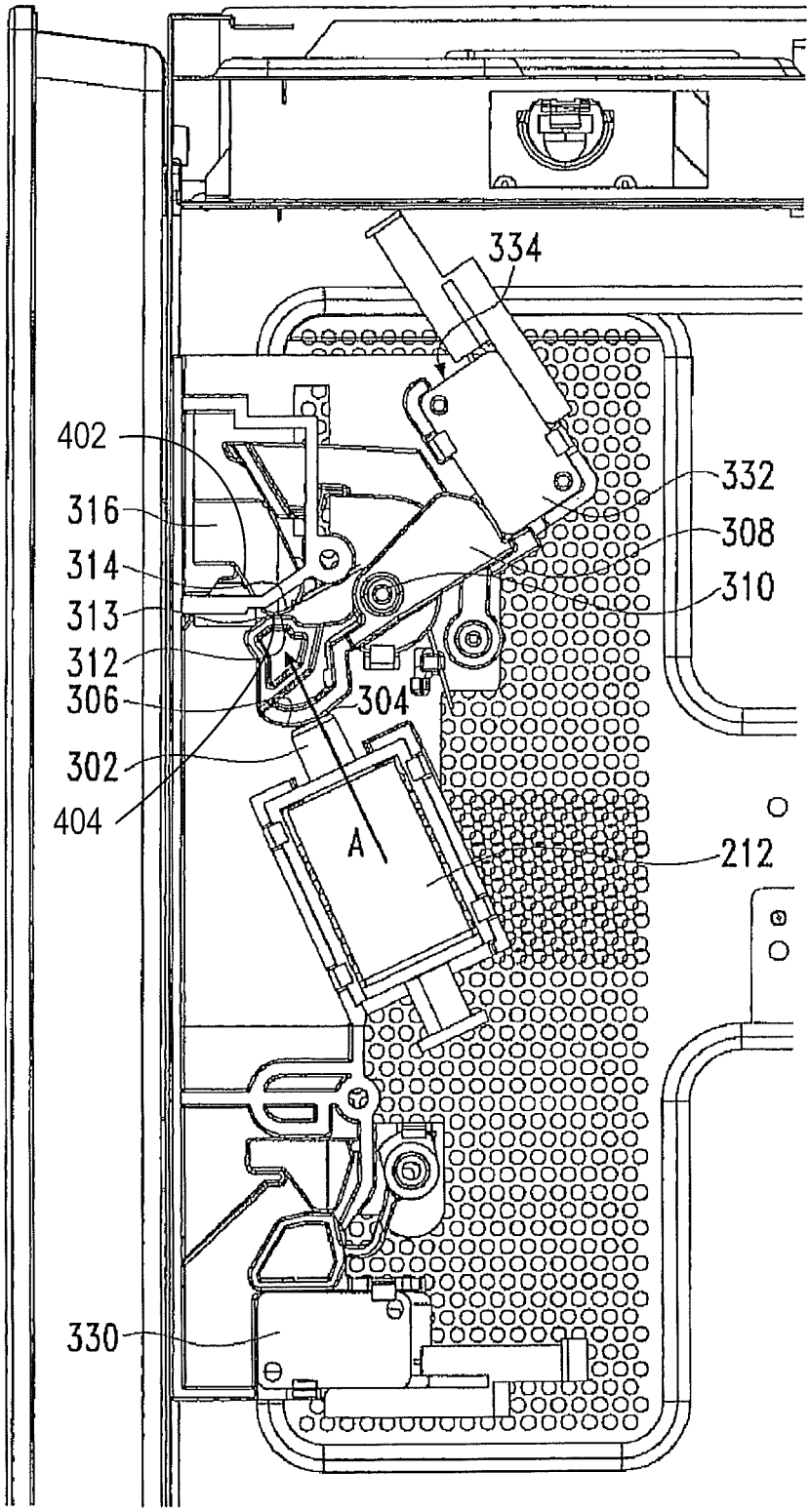
FIG. 3 depicts partial internal views of the oven of FIG. 1, showing the retention mechanism, and actuation thereof by the actuator, in accordance with embodiments of the present invention, (a) with the door in the closed position, (b) at the half travel point, and (c) at the door open position.
Figure 3B:
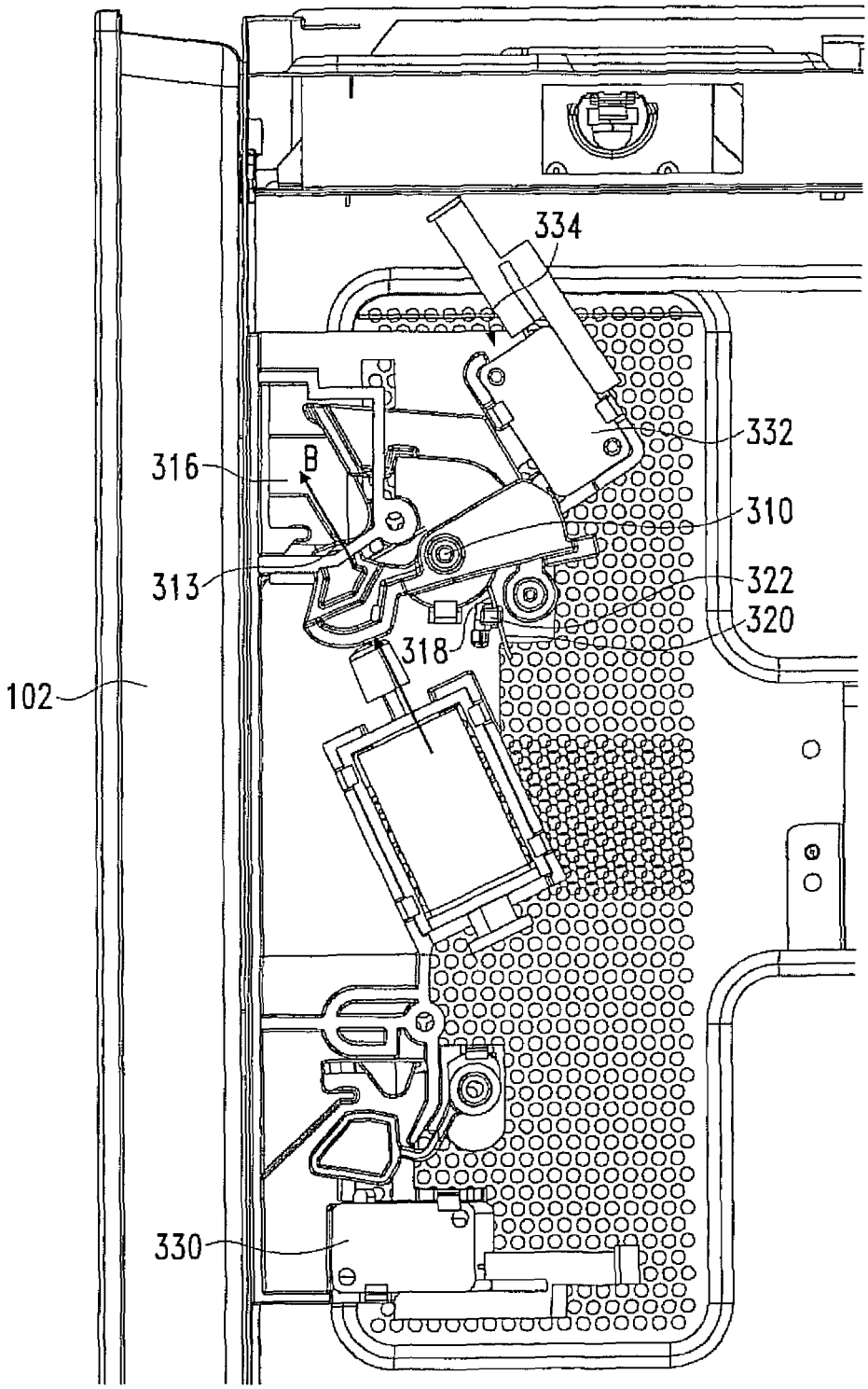
Figure 3C:
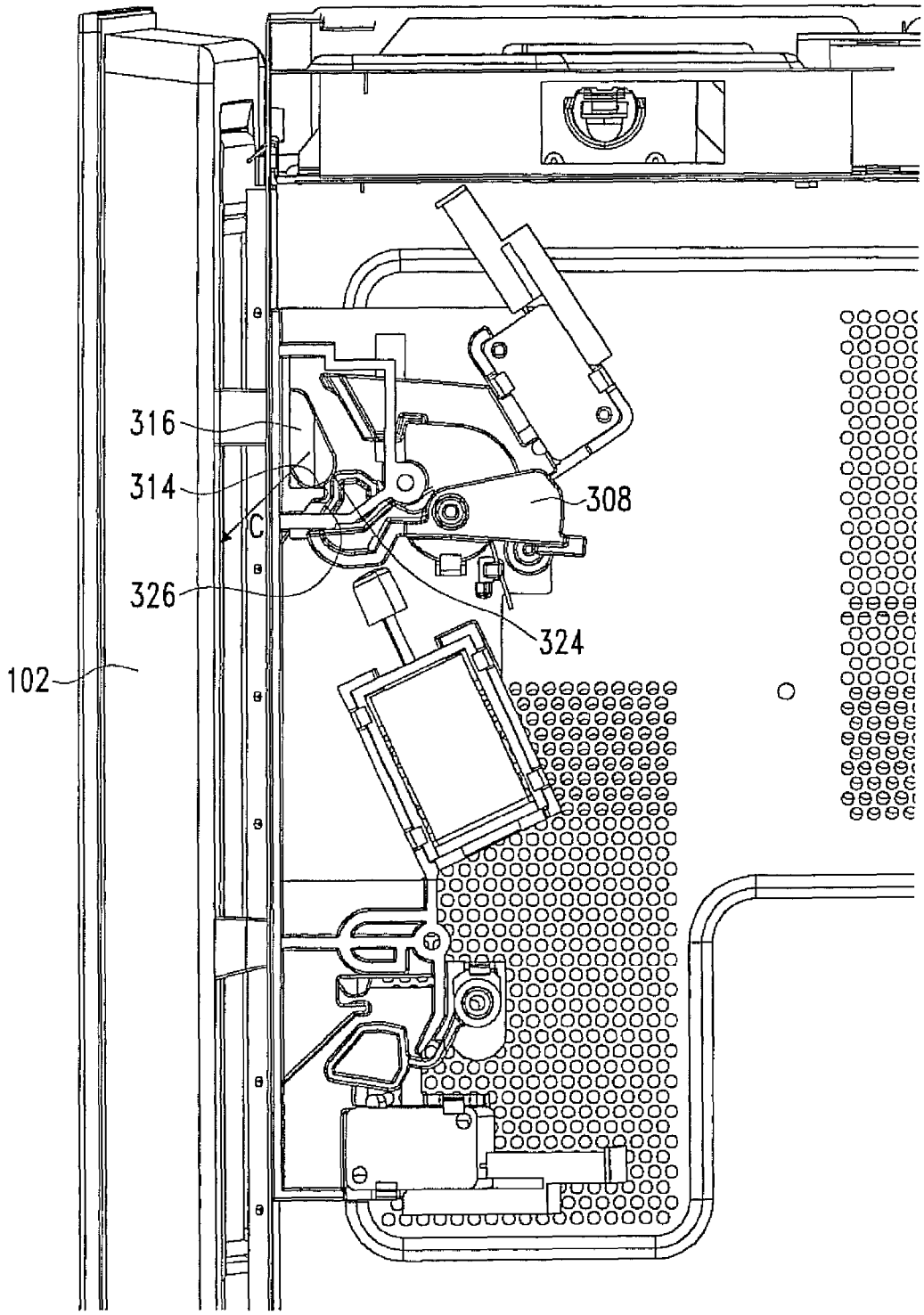

FIG. 3 depicts partial internal views of the oven of FIG. 1, showing the retention mechanism, and actuation thereof by the actuator, in accordance with embodiments of the present invention, (a) with the door in the closed position, (b) at the half travel point, and (c) at the door open position.

Referring to FIG. 3(*a*), the solenoid 212 includes an armature 302 that moves in the direction of arrow A when the solenoid 212 is powered during the door opening action. The armature has a smoothed partially rounded end 304 that abuts, during the door opening action, a rounded portion 306 of hook spacer 308.

During the door opening action, the hook spacer 308 rotates about axis 310, and a first sloping portion 312 of the hook spacer 308 abuts and pushes upwards upon a tip 314 of door key 316.

Accordingly (referring to FIG. 3(*b*)), at the half travel point, the door key 316, attached to the door 102 has moved upwards in the direction of arrow B and is close to the release point of the door 102. As will also be seen, a coil spring 318 is provided, centred on the axis 310 and having one end 320 fixed to the housing by a clamp 322. The other end (not shown) of the coil spring 318 is attached to, and acts upon, the door 102.

Referring to FIGS. 3(*a*) and 3(*b*), some embodiments provide that the retention mechanism includes a hook spacer 308, which, as illustrated is a rotatable member 308 that rotated, in use, by the electromechanical actuator while the actuator is activated and a spring biasing element 318, wherein, in use, during at least part of the movement of the retention mechanism between the first configuration and the second configuration, the spring biasing element 318 acts on the door, such that the door rotates to a partially open position. Some embodiments provide that the rotatable member 308 has a guide surface 404, the guide surface 404 including a transition point and being disposed such that, in use, a door key or key member 316 attached to the door is capable of sliding contact with the rotatable member 308 along the guide surface 404, wherein after the key member 316 has slid beyond the transition point 324, forces due to gravity and to the spring biasing element 318 operate on the door such that the door rotates to the partially open position.

Referring now to FIG. 3(*c*), at the point indicated therein, the door is effectively released: the tip 314 of door key 316 has passed the corner 324 of hook spacer 308, and the tip 314 is free to move, urged by the coil spring 318, down the sloping section or surface 326 of the hook spacer 308 (i.e. in the direction of arrow C), and thereby push the door 102 to an open position (in FIG. 3(*c*), the door is indicated as partially open by a small angle.

Although particular embodiment(s) of the present invention have been shown and described, it will be understood that it is not intended to limit the invention to the preferred embodiment(s) and it will be obvious to those skilled in the art that various changes and modifications may be made without departing from the spirit and scope of the present invention. Thus, the invention is intended to cover alternatives, modifications, and equivalents, which may be included within the spirit and scope of the invention as defined by the claims.

All publications, patents, and patent applications cited herein are hereby incorporated by reference in their entirety for all purposes.

The invention claimed is:

1. A domestic appliance, comprising:

a housing;

a front door;

a retention mechanism, located within the housing and engageable with a key member attached to the door, the key member being able to move upwards and downwards;

wherein the retention mechanism is movable between a first configuration, in which the door is retained in a closed position, and a second configuration, in which the door is non-engaged;

an electromechanical actuator, adapted to move the retention mechanism out of said first configuration; and a controller, coupled to the actuator, the controller being operable in response to one or more signals to activate the actuator, and thereby release the door from the closed position, wherein the retention mechanism comprises a rotatable member having a guide surface disposed such that, in use, the key member is capable of sliding contact with the rotatable member along the guide surface, wherein the key member includes an end portion extending in a downwardly inclined direction, and wherein, when the retention mechanism is in the first configuration, a first portion of the guide surface and downwardly inclined portion of the key member being disposed so as to allow sliding movement of the end portion upwards and over the first portion when an outward pulling force is applied to the door, whereby the retention mechanism moves out of the first configuration.

2. The appliance of claim 1, wherein in use, the electromechanical actuator moves the rotatable member into a position such that a spring biasing element acts on the door such that the door rotates to a partially open position.

3. The appliance of claim 2, wherein the guide surface includes a transition point and being disposed such that, in use, the key member attached to the door is capable of sliding contact with the rotatable member along the guide surface;

wherein, after the key member has slid beyond the transition point, forces due to gravity and to the spring biasing element operate on the door such that the door rotates to the partially open position.

4. The appliance of claim 1, wherein the controller is operable in a switch-activated mode;

the housing is provided thereon with an electrical switch, coupled to the controller and operable by a user; and the controller is operable, in use, to activate such actuator when the detected signal from said electrical switch is HIGH.

5. The appliance of claim 4, wherein the electrical switch comprises a touch switch.

6. The appliance of claim 1, wherein:

the controller is alternatively or additionally operable in a remote activated mode;

the housing is provided thereon with a wireless receiver unit, coupled to the controller and operable by a user remote unit; and the controller is operable, in use, to activate said actuator when the detected signal from said wireless receiver unit is HIGH.

7. The appliance of claim 6, wherein the wireless receiver unit comprises an infra-red (IR) receiver, and wherein the user remote unit comprises an IR remote control.

8. The appliance of claim 1, the appliance being capable of performing a temporary electrical operation, wherein:

the controller is alternatively or additionally operable in an auto-open mode, the housing is provided thereon with a user selection interface, coupled to the controller and operable by a user, the user selection interface including an auto-open setting selectable, in use, by the user, the controller is coupled for receiving an input signal (HIGH, LOW), indicative of whether the electrical operation in the appliance is on or off, respectively, the controller is operable, in use, to active said actuator when the received signal is LOW, and the user interface comprises buttons and/or dials and a display.

9. The appliance of claim 8, the appliance being capable of performing a temporary electrical operation, wherein, the controller is alternatively or additionally operable in an delayed auto-open mode;

the controller is coupled to a memory device, for storing a time period;

the controller is coupled for receiving an input signal (HIGH, LOW), indicative of whether the electrical operation in the appliance is on or off, respectively, and whereby the controller is operable, in use, to activate said actuator when the controller determines that (a) the received signal is LOW, and (b) said time period has elapsed.

10. The appliance of claim 9, wherein the user selection interface including a delayed auto-open setting selectable, in use, by the user;

wherein the user selection interface is operable by the user for inputting said time period prior to storage in the memory device.

11. The appliance of claim 9, wherein the time period is approximately (a) 1-20 seconds, (b) up to 1 minutes, or (c) 1-5 minutes.

12. The appliance of claim 8, wherein the appliance is (a) an oven, and the temporary electrical operation is cooking by means of any combination of microwave, grill, convention or steaming, or (b) a breadmaker, yoghurt maker, and the temporary electrical operation is electrical warming or heating.

13. The appliance of claim 8, wherein the user interface comprises buttons and/or dials and a display.

14. The appliance of claim 1, wherein instead of being operable in response to a detected or received signal being HIGH, the controller is operable in response to the detected or received signal being LOW or the detected or received signal undergoing any predetermined change in state or voltage level.

15. The appliance of claim 1, wherein the electromechanical actuator comprises a solenoid, an armature of the solenoid cooperating, in use with the retention mechanism.

16. The appliance of claim 1, wherein the retention mechanism further comprises:

a spring biasing element that is located within the housing; and the rotatable member that is operable to be rotated by the electromechanical actuator when the electromechanical actuator is activated.

17. A domestic appliance, comprising:

a housing;

a front door;

a retention mechanism, located within the housing and engageable with a key member attached to the door, the key member being able to move upwards and downwards;

wherein the retention mechanism is movable between a first configuration, in which the door is retained in a closed position, and a second configuration, in which the door is non-engaged;

an electromechanical actuator, adapted to move the retention mechanism out of said first configuration; and a controller, coupled to the actuator, the controller being operable in response to one or more signals to activate the actuator, and thereby release the door from the closed position, wherein the retention mechanism comprises a rotatable member having a guide surface disposed such that, in use, the key member is capable of sliding contact with the rotatable member along the guide surface, wherein the key member includes an end portion that is configured to extend in a downwardly inclined direction, wherein, when the retention mechanism is in the first configuration, a first portion of the guide surface and downwardly inclined portion of the key member being disposed so as to allow sliding movement of the end portion upwards and over the first portion when an outward pulling force is applied to the door, whereby the retention mechanism moves out of the first configuration, wherein the guide surface includes a transition point, and wherein, after the key member has slid beyond the transition point, forces due to gravity and to a spring biasing element operate on the door such that the door rotates to the partially open position.

18. A domestic appliance, comprising:

a housing;

a front door;

a retention mechanism, located within the housing and engageable with a key member attached to the door, the key member being able to move upwards and downwards;

wherein the retention mechanism is movable between a first configuration, in which the door is retained in a closed position, and a second configuration, in which the door is non-engaged;

an electromechanical actuator, adapted to move the retention mechanism out of said first configuration; and a controller, coupled to the actuator, the controller being operable in response to one or more signals to activate the actuator, and thereby release the door from the closed position, wherein the retention mechanism comprises a rotatable member having a guide surface disposed such that, in use, the key member is capable of sliding contact with the rotatable member along the guide surface, wherein the key member includes an end portion extending in a downwardly inclined direction, and wherein, when the retention mechanism is in the first configuration, a first portion of the guide surface and downwardly inclined portion of the key member being disposed so as to allow sliding movement of the end portion upwards and over the first portion after a door opening action, whereby the retention mechanism moves out of the first configuration.

* * * * *